US008286692B2

(12) United States Patent
Fugarolas

(10) Patent No.: US 8,286,692 B2
(45) Date of Patent: Oct. 16, 2012

(54) METHOD FOR REDUCTION OF INTERSTITIAL ELEMENTS IN CAST ALLOYS AND SYSTEM FOR PERFORMING THE METHOD

(76) Inventor: Daniel Gaude Fugarolas, Vilassar De Mar (ES)

( * ) Notice: Subject to any disclaimer, the term of this patent is extended or adjusted under 35 U.S.C. 154(b) by 0 days.

(21) Appl. No.: 13/199,221

(22) Filed: Aug. 22, 2011

(65) Prior Publication Data

US 2012/0048497 A1 Mar. 1, 2012

Related U.S. Application Data

(63) Continuation of application No. PCT/IB2010/050784, filed on Feb. 23, 2010.

(30) Foreign Application Priority Data

Feb. 24, 2009 (ES) ..... 200900505

(51) Int. Cl.
*B22D 27/04* (2006.01)

(52) U.S. Cl. ..... 164/477; 164/76.1

(58) Field of Classification Search ..... 164/76.1, 164/477
See application file for complete search history.

(56) References Cited

U.S. PATENT DOCUMENTS

| | | | | |
|---|---|---|---|---|
| 4,665,970 | A | 5/1987 | Ohno | |
| 5,900,083 | A * | 5/1999 | Reed et al. | 148/672 |
| 2008/0173543 | A1 * | 7/2008 | Ziani | 204/298.13 |

FOREIGN PATENT DOCUMENTS

| | | |
|---|---|---|
| JP | 2007 160341 | 6/2007 |
| WO | WO 94/24320 | 10/1994 |

* cited by examiner

*Primary Examiner* — Kuang Lin
(74) *Attorney, Agent, or Firm* — Lawrence G. Fridman

(57) ABSTRACT

The method for reducing interstitial elements in alloy castings which comprises the following steps: pouring the alloy for the formation of a casting; and allowing said alloy to cool. According to the method, at least a peripheral region of the casting is heated, so that the flux of interstitial elements is caused towards the at least one peripheral region. The method is achieved where most of the interstitial elements concentrate in at least one region in the surface region of the casting. At later stages these elements can be easily eliminated from the respective regions by means of a thermal surface treatment or surface machining of the casting.

9 Claims, 2 Drawing Sheets

METHOD FOR REDUCTION OF INTERSTITIAL ELEMENTS IN CAST ALLOYS AND SYSTEM FOR PERFORMING THE METHOD

This application is a Continuation of currently pending PCT/IB2010/050784 filed Feb. 23, 2010, which Application claims priority of Spanish Patent Application P200900505 filed Feb. 24, 2009.

FIELD OF THE INVENTION

The present invention relates to a method for reducing interstitial elements in cast alloys. Specifically, it relates to a method for reducing hydrogen in steel castings. The present invention also relates to a system for performing this method, which can be integrated into a mold or a continuous casting system.

BACKGROUND OF THE INVENTION

Throughout this document, the term interstitial elements refers to those atoms that, because of their small size with respect to the main elements in the alloy, are able to diffuse interstitially, that is, via the spaces in the metallic crystalline lattice, without the need to displace other atoms from their positions in the lattice. In the case of many alloys, like steel, atoms like hydrogen, nitrogen carbon and others can act like interstitial elements.

It is known that hydrogen is an interstitial element that can cause the embrittlement of steel components. Specifically, the sensitivity to hydrogen embrittlement is more evident in high-strength alloys.

Various mechanisms have been described as responsible for said embrittlement. These mechanisms do not begin to materialize as long as the temperature does not drop below a given threshold so that the interstitial elements in question feature a reduced mobility and an insufficient solubility, and tend to combine with other elements to form embrittling compounds.

It is known that hydrogen features a solubility which varies from one metallurgical phase to another and at the same time, solubility increases within each phase as temperature increases. For example, in the case of the solid phases of steel, hydrogen solubility ranges between 8 ppm in high temperature austenite (1400° C.), and less than 1 ppm in room temperature ferrite, and it is approximately 30 ppm in the liquid phase at 1600° C.

It can be considered that the phenomenon of diffusion of interstitial elements is governed mainly by the interstitial atom's thermal agitation within the crystalline lattice, i.e., at higher temperatures, greater thermal agitation and, therefore, greater probability of diffusion. Although the situation usually considered is the diffusional flux occurring from high concentration regions towards regions of lower concentration this is not the only possible scenario. Rigorously, the driving force behind diffusional fluxes is the free energy reduction of the system. To be still more precise, diffusion occurs from areas of high chemical potential to areas of lower chemical potential.

Nevertheless, it can be shown that whenever the atomic mobility is sufficient, and in absence of composition differences or other factors which could cause a more important flux, a high temperature gradient also causes a net flux of interstitial elements towards higher temperature regions. This effect is produced because, on the one hand, as regions at higher temperature are in a state of lower saturation, as they feature greater solubility, and therefore they would have a lower chemical potential than regions at higher saturation in the same temperature conditions. On the other hand, the flux towards high temperature regions is encouraged by the increase in atomic mobility as the temperature increases.

The presence of hydrogen in metallic alloys, especially in steels, is due to several reasons, from the presence of humidity in the raw materials or equipment or the decomposition of compounds present in the later, as well as actions performed during the alloy casting and refining process, for example those where hydrogen is blown through the molten metal with the aim of eliminating other elements, with the final consequence that some fraction of the hydrogen used remains dissolved in the molten metal.

During the casting process, heat extraction from the metal occurs through the walls of the mold and from the free surfaces of the cast metal.

In this manner, the cast metal generally cools from the surface to the core of the casting. That is, the casting's core remains at higher temperature than its surface, producing an increasing temperature gradient from the surface towards the core.

This marked temperature gradient, at temperatures at which interstitial elements such as hydrogen still feature a high mobility, produces a flux of interstitial elements towards the casting core, due to its higher temperature and greater capacity to dissolve said elements with respect to the adjacent regions which are at lower temperatures.

This diffusive flux tends to concentrate the total content of the interstitial element in question in the core region of the casting.

Due to the damaging effect of hydrogen in the mechanical properties of the components produced, traditionally different systems have been used to eliminate it.

These systems can be divided into two families: The use of certain additions during the refining process or the exposure of the molten metal to a reduced pressure.

The first of these methods consists in the addition of refining elements or substances that would combine with hydrogen (or other elements) and form insoluble substances that could be then eliminated during the refining process.

The second system consists in exposing the molten metal to an atmosphere with reduced pressure, as hydrogen solubility in the molten metal is function of pressure as well as of temperature and crystalline structure.

This second system produces a better hydrogen elimination rate, although at the expense of a large increase in the investment for the necessary equipment. For its part, the first system entails a much smaller investment, but it has also a lower hydrogen reduction rate, so that it is much less effective. Furthermore, this first system has the added issue that implies the modification of the alloy composition.

Therefore, the need is clear for a method which reduces interstitial elements, particularly hydrogen, in a casting process, without the modification of the alloy composition (with the exception of interstitial elements themselves) and furthermore, without requiring a large investment such as in the case of vacuum casting and refining.

BRIEF SUMMARY OF THE INVENTION

The previously discussed drawbacks are resolved by the method and the system of the invention, featuring other advantages which will be described below.

According to one aspect, the method for reducing interstitial elements in alloy castings of the present invention comprises the steps of:

injecting said alloy in a system for the formation of a casting or a continuous cast;

allowing said alloy to cool;

wherein at least a peripheral region of the casting is heated, so that the flux of interstitial elements occurs towards at least one the peripheral region.

Consequence of this feature, a method is achieved where most of the interstitial elements concentrate in one or several regions in the surface region of the casting. Later on, such elements can easily be eliminated from these regions by means of a thermal surface treatment or surface machining of the casting.

Preferably, at least one peripheral region is heated before the alloy cools to a temperature low enough for the formation of embrittling compounds.

According to another aspect of the invention, at least one peripheral region is heated at a temperature between 900° C. and the melting point of the alloy.

Such heating of each peripheral region is preferably maintained until any part of the piece, different than the peripheral regions, is at a temperature of less than 400° C.

According to a further aspect of the invention, the interstitial elements are hydrogen, carbon, nitrogen, boron, argon, or other interstitial elements or other elements which feature high diffusivity in the alloy matrix, and said alloy is a steel alloy, iron, copper, nickel, titanium, cobalt, chrome or others with melting points greater than 800° C., as well as some alloys with lower melting points, such as aluminium alloys.

According to still another aspect of the invention, the system for reducing interstitial elements in cast alloys comprises at least one heating element situated on the periphery of the cast.

According to still a further aspect of the invention, each heating element is an electric resistor or an induction coil, and each heating element is complemented with a temperature sensor.

According to sill another aspect, the complete system of the invention can be applied both to mold casting and continuous casting systems.

BRIEF DESCRIPTION OF THE DRAWINGS

The foregoing summary as well as the following detailed description of the invention will be best understood when considered in conjunction with the accompanying drawings, and wherein.

DETAILED DESCRIPTION OF THE INVENTION

Figure 1:
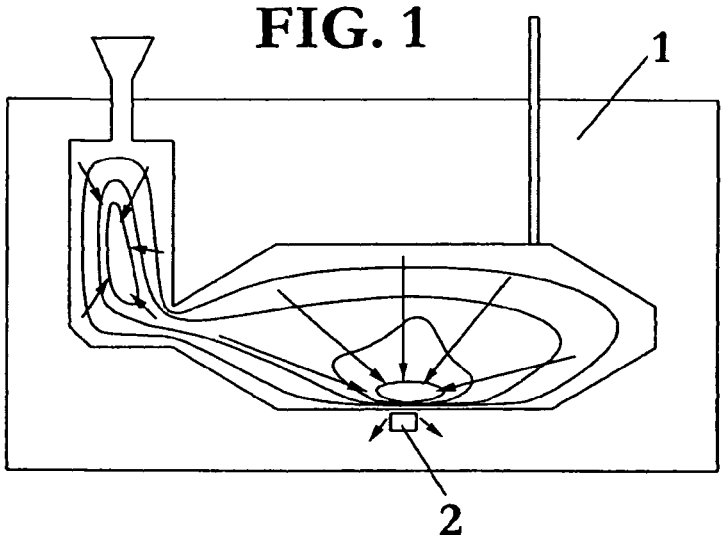
FIGS. 1 and 2 are schematic views of a casting system according to the present invention, representing the flux of interstitial elements and the isothermal curves in the cast alloy.
Figure 2:
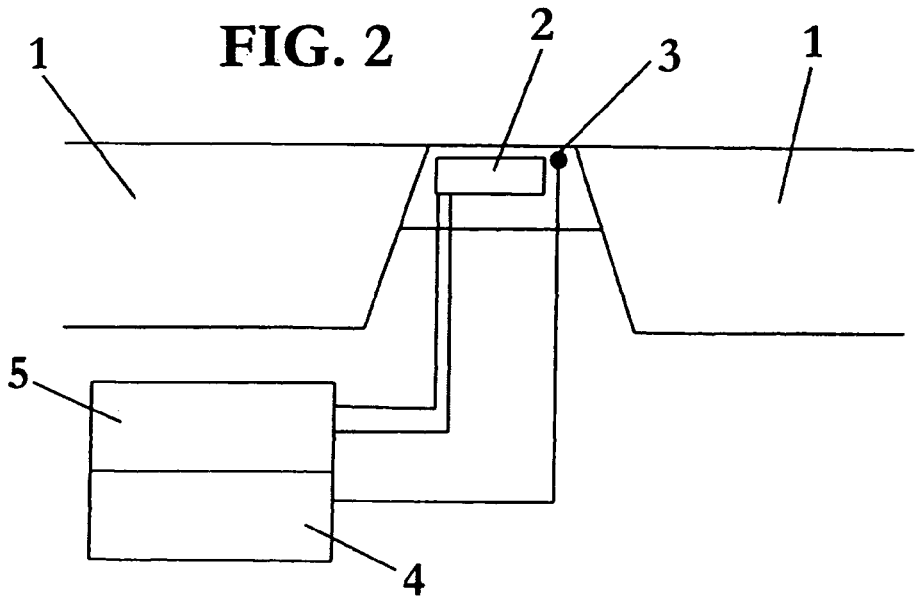

It should be noted that although the present description corresponds to the case of hydrogen reduction during steel casting, the scope of application of the method of the present invention extends to any alloy casting wherein a reduction in the amount of dissolved hydrogen or of any other interstitial element is desired, such as, for example, carbon, nitrogen, boron and others.

Unlike the method of the previously described techniques, according to the method of the present invention the existence of a increasing temperature gradient is forced and directed towards one or more points on the surface of the piece, so that the flux of interstitial elements occurs towards the surface, instead of towards the core of the casting.

In this way, the interstitial elements will be eliminated from the casting by simple diffusion through the surface of the piece, and any remainder concentrates in a region close to the surface, so that it can easily be eliminated by means of a subsequent thermal surface treatment and/or surface machining of the casting.

In order to obtain a temperature gradient favourable to force the interstitial element flux towards the surface of the casting, it is necessary to maintain at least one region of the surface of the casting at a sufficiently high temperature during the solidification and cooling process, so that it is maintained at a higher temperature than the rest of the casting till the end of the process.

In the event of wanting to eliminate an element such as hydrogen, which tends to combine with other atoms, forming embrittling compounds, it is important to ensure that this method is initiated before the piece cools to temperatures at which said embrittling compound formation reactions occur.

As observed in the figures, the system, in this case a mold, indicated generally by means of the numeric reference 1, comprises a heating element 2.

It must be pointed out that even though one heating element 2 has been represented in the figures for the sake of simplicity, it is clear that there can be any suitable number of heating elements, depending on the shape and dimensions of the mold.

The or each heating element 2, which is integrated into the mold wall 1 and begins to actuate during the pouring of the molten alloy into the mold, can consist of an induction coil, duly protected from the liquid metal, or of an electric resistor, or any suitable heating element.

One requirement of this heating element is that it must be built into the mold, at a distance which is sufficiently close to the inner surface of the mold and which reliably permits the region of the surface of the piece to be kept at a suitable temperature.

Another essential requirement of the heating element is its capacity to endure temperatures higher than that of the alloy's melting point, and especially the thermal shock produced during the filling of the mold.

For example, in the event of treating cast steel pieces, the temperature to be maintained can exceed 1400° C., and the temperature of the molten metal can exceed 1600° C.

In the event that an electric resistor is used as a heating element, this can be built integrated into the wall of the mold, surrounded and protected for example by an alloy resistant to the temperature, or ceramic refractory material, or even integrated into the wall of the mold in the case of sand casting.

Heating elements using an electric resistor are expected to be tougher and less expensive, and might require a simpler control system, than in the case of an induction coil, although they feature a larger heat lag.

If the heating element is realised using an induction coil, the surrounding material must not be conductive in order to prevent the generation of induced currents, since these induced currents would heat the heating element or the walls of the mold, instead of the surface of the casting.

Each heating element 2 is connected to a temperature sensor 3, a control system 4 and an energy supply system 5.

The control system 4 is required to adjust the temperature of the heated peripheral region (or hot spot) and could be similar to those normally used for automated surface induction heat treatments.

Additionally, the type and the placement of the temperature sensor 3 must be suitable to prevent the magnetic field generated by the induction coil from distorting the temperature measurement, and this must be situated so that it directly measures the temperature of the surface of the casting.

In this sense, a heating element 2 based on an induction coil it is expected to require a slightly greater investment than that based on a resistor, but has the advantage that it permits a much quicker and precise modulation of the temperature obtained.

Figure 3:
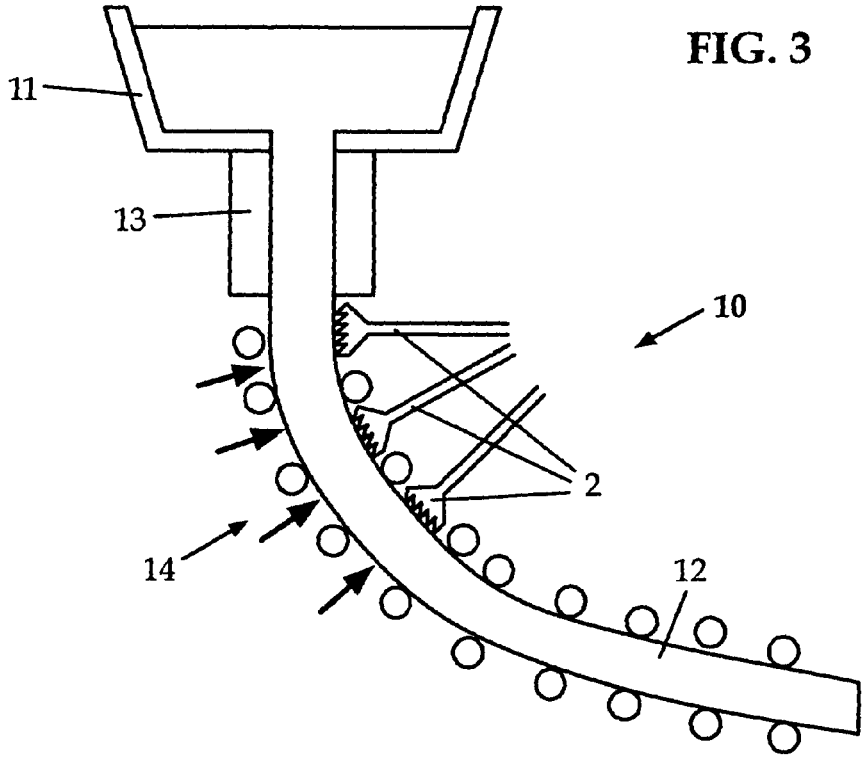
FIG. 3 is a schematic view of a continuous casting system according to the present invention.

An alternative embodiment to mold 1 of FIG. 1 has been represented in FIG. 3, which depicts the application of he method to a continuous casting system. In this embodiment, the same numeric references have been maintained to identify elements equivalent to those in the previous embodiment.

A continuous casting system 10, whose main functioning is identical to that of the mold 1, is represented in FIG. 3.

In this case, the molten metal is deposited in a distribution tank 11, wherefrom it forms a cast bar 12 by means of a cooled ingot mold 13.

At the outlet of the ingot mold 13, the cast bar 12 is cooled on one side by means of a cooling section 14, while the heating elements 2 are situated in contact with one of the surfaces of the cast bar 12. Its ideal arrangement is next to the outlet of the ingot mold 13 and along the section of the refrigeration 14 on its opposite side.

The cast bar 12 can be cooled with water jets or spray, as it is conventional practice, although protecting from said cooling process the side where the heat is applied for the elimination of the interstitial elements (the heated peripheral region or hot spot).

Table 1 contains some examples of the range of temperatures implied in the method of the present invention, for different alloys.

It must be pointed out that the temperature whereat the peripheral regions of the mold have to be maintained have to be as high as possible from a practical point of view, but comfortably less than the melting point of the alloy.

TABLE 1

Illustrative values, for different alloys, of the melting temperature, the temperature at which hot spots on the surface of the casting should be kept at and the critical core temperature.

| Alloy | Melting point | Hot spot temperature | Critical temperature |
|---|---|---|---|
| Low C steel | 1750° C. | 1000° C.-1700° C. | 400° C. |
| High C steel | 1580° C. | 1000° C.-1500° C. | 400° C. |
| Alloy steel | 1700° C. | 1000° C.-1600° C. | 400° C. |
| Cast iron | 1400° C. | 1000° C.-1350° C. | 400° C. |
| Copper | 1350° C. | 900° C.-1300° C. | 400° C. |
| Nickel alloys | 1550° C.-1700° C. | 1000° C.-1600° C. | 400° C. |

Regarding the holding time necessary at each heated peripheral region or hot spot, this time at temperature depends on the volume and the geometry of the casting in question. Nevertheless, it must be stressed the importance that the heating elements produce the hot spots on the surface of the casting must be active from the moment when the mold is filled. These hot spots must also be held at the suitable temperature until the temperature of the core of the casting has decreased below a critical temperature (approximately 400° C.).

Once the core reaches such said critical temperature, the power applied to the heating element can be slowly reduced, always guaranteeing that the hot spot is at a higher temperature than the core regions of the casting, until both are below the critical temperature. The time necessary to cool the core below the critical temperature can be estimated from some simple modelling of mold and casting cooling.

Despite having referred to a specific embodiment of the invention, it is clear for a person skilled in the art that the method and the mold disclosed can undergo numerous variations and modifications, and that all of the mentioned details can be substituted for other technically equivalent details, without departure from the scope of protection defined by the attached claims.

For example, possible modifications can be as follows:

- instead of using a temperature measurement system, the control system can be managed by other means (for example, simply by determining, via modelling or experimentally the holding time necessary for each hot spot(s) to produce the right effect and setting their heating time accordingly);
- the heat applied to the surface of the casting do not need to be continuous, but followed a suitable function, with varying intensity;
- the surface heating of the surface of the casting is maintained until the core temperature drops below 400° C.;
- the interstitial elements do not need only to be diffused to the region below the surface where the heating is being applied, but due to the proximity of such surface, a fraction of such interstitial elements could diffuse out of the metal (desorption) and, therefore, obtaining their elimination from the casting; and
- the heating elements could be implemented either integrated in the mold walls, or as removable attachments associated therewith.

The invention claimed is:

1. A method for reducing interstitial elements in alloy castings, at least one of said interstitial elements being selected from a group consisting of hydrogen, carbon, nitrogen, boron and argon, said method comprises the steps of:

- pouring a melted alloy for formation of a casting;
- cooling said alloy, while simultaneously heating one or more spots at a surface of said casting, said heating being provided to produce an increasing temperature gradient to be directed toward said one or more spots at the surface of the casting; and
- maintaining said one or more spots of the casting at an elevated temperature higher than a temperature of the remaining surface and interior of the casting, said elevated temperature being maintained until the temperature of any part of the casting different from said one or more spots has decreased below a critical temperature of approximately 400° C., so that in said step of cooling a flux of the interstitial elements is directed toward said one or more spots and away from the core of the casting.

2. The method according to claim 1, wherein said one or more spots are heated before the alloy cools to a temperature sufficient for the formation of embrittling compounds.

3. The method according to claim 2, wherein said one or more spots are heated at a temperature between 400° C. and the melting point of the cast alloy.

4. The method according to claim 1, wherein said alloy is selected from the group including steel, iron, copper, nickel, titanium, cobalt and chrome.

5. The method according to claim 1, wherein said interstitial elements also include elements exhibiting high diffusivity in the alloy matrix.

6. The method according to claim 4, wherein said alloys have melting points exceeding 800° C.

7. The method according to claim 4, wherein said alloys further include alloys with lower melting points, including aluminium alloys.

8. The method according to claim 1, wherein at said critical temperature mobility of the interstitial elements is reduced, so that the diffusion flux of said elements is substantially reduced.

9. A method for reducing interstitial elements in alloy castings, at least one of said interstitial elements being selected from a group consisting of hydrogen, carbon, nitrogen, boron and argon, said method comprises the steps of:

pouring a melted alloy for formation of a casting;

cooling said alloy, while simultaneously heating one or more spots at a surface of said casting, said heating being provided to produce an increasing temperature gradient to be directed toward said one or more spots at the surface of the casting; and maintaining said one or more spots of the casting at an elevated temperature higher than a temperature of the remaining surface and interior of the casting, said elevated temperature being maintained until the temperature of any part of the casting different from said one or more spots has decreased below approximately 400° C., so that in said step of cooling a flux of the interstitial elements is directed toward said one or more spots and away from the core of the casting.

* * * * *

UNITED STATES PATENT AND TRADEMARK OFFICE

CERTIFICATE OF CORRECTION

PATENT NO. : 8,286,692 B2
APPLICATION NO. : 13/199221
DATED : October 16, 2012
INVENTOR(S) : Daniel Gaude Fugarolas It is certified that error appears in the above-identified patent and that said Letters Patent is hereby corrected as shown below:

Title Page, Item (75) Inventor:

Amend the name of the Inventor to read:

-- Gaude Fugarolas, Daniel --

Signed and Sealed this
Twenty-sixth Day of March, 2013

Teresa Stanek Rea

Teresa Stanek Rea
*Acting Director of the United States Patent and Trademark Office*